US007839241B2

(12) United States Patent
Weber et al.

(10) Patent No.: US 7,839,241 B2
(45) Date of Patent: Nov. 23, 2010

(54) ELECTRICAL SERVICE SWITCHING DEVICE

(75) Inventors: Ralf Weber, Heidelberg (DE); Erwin Muders, Heidelberg (DE); Klaus-Peter Eppe, Waldbrunn (DE); Joachim Becker, Schwetzingen (DE)

(73) Assignee: ABB AG, Mannheim (DE)

( * ) Notice: Subject to any disclaimer, the term of this patent is extended or adjusted under 35 U.S.C. 154(b) by 59 days.

(21) Appl. No.: 12/124,277

(22) Filed: May 21, 2008

(65) Prior Publication Data

US 2008/0290971 A1 Nov. 27, 2008

(30) Foreign Application Priority Data

May 23, 2007 (DE) ..... 10 2007 024 268
Jan. 31, 2008 (DE) ..... 10 2008 006 863

(51) Int. Cl.
*H01H 81/00* (2006.01)
*H01H 83/00* (2006.01)
*H01H 75/12* (2006.01)
*H01H 77/00* (2006.01)

(52) U.S. Cl. ..... 335/35; 335/6

(58) Field of Classification Search ..... 335/35, 335/6

See application file for complete search history.

(56) References Cited

U.S. PATENT DOCUMENTS 3,602,674 A * 8/1971 Koennecke et al. ..... 200/401
4,417,222 A * 11/1983 Schmitt et al. ..... 335/6
4,687,891 A * 8/1987 Bartolo et al. ..... 200/560
4,897,625 A * 1/1990 Yokoyama et al. ..... 335/14
4,916,420 A * 4/1990 Bartolo et al. ..... 335/172
RE33,400 E * 10/1990 Fujii et al. ..... 335/26
5,003,139 A * 3/1991 Edds et al. ..... 200/401

(Continued)

FOREIGN PATENT DOCUMENTS

DE 10 2004 055 564 A1 6/2006

(Continued)

OTHER PUBLICATIONS

European Search Report issued Sep. 5, 2008 in corresponding European Patent Application EP 08 00 6388.

*Primary Examiner*—Elvin G Enad
*Assistant Examiner*—Alexander Talpalatskiy
(74) *Attorney, Agent, or Firm*—Buchanan Ingersoll & Rooney PC

(57) ABSTRACT

The disclosure relates to an electrical service switching device, e.g., a circuit breaker, having a magnetic release with a magnet armature, a thermal release, a fixed and moving contact piece, a switching mechanism which can be tripped by the thermal and magnetic release and has a latching point which is formed by a tripping lever and a catch lever which is mounted in a fixed position such that it can rotate and has an elongated hole in order to guide a clip, wherein the magnet armature can act on the contact lever, to which the moving contact piece is fitted, in order to open the contact point in the event of a short, and the switching mechanism can hold the contact lever permanently in the open position, having a switching toggle for manual operation of the switching mechanism, and having an intermediate lever which is articulated at one of its ends with the contact lever and at its other end on the clip, wherein the clip is articulated with at least one limb on the switching toggle.

23 Claims, 8 Drawing Sheets

U.S. PATENT DOCUMENTS

| | | | | |
|---|---|---|---|---|
| 5,162,765 | A * | 11/1992 | DiVincenzo et al. | 335/175 |
| 6,262,643 | B1 * | 7/2001 | Lassalle | 335/21 |
| 6,492,607 | B2 * | 12/2002 | Bruckert et al. | 200/401 |
| 6,667,680 | B1 * | 12/2003 | Gibson et al. | 336/172 |
| 7,009,129 | B2 * | 3/2006 | Vierling | 200/400 |
| 2002/0196108 | A1 * | 12/2002 | Millburn et al. | 335/6 |
| 2008/0001687 | A1 | 1/2008 | Weber et al. | |

FOREIGN PATENT DOCUMENTS

| | | | |
|---|---|---|---|
| EP | 0 144 799 | B1 | 6/1985 |
| EP | 0 295 158 | A | 12/1988 |
| EP | 0 338 930 | A | 10/1998 |
| WO | WO 98/53473 | A | 11/1998 |

* cited by examiner

ELECTRICAL SERVICE SWITCHING DEVICE

RELATED APPLICATIONS

This application claims priority under 35 U.S.C. §119 to German Patent Application No. 10 2007 024 268.0 filed in Germany on May 23, 2007, and German Patent Application No. 10 2008 006 863.2 filed in Germany on Jan. 31, 2008, the entire contents of which are hereby incorporated by reference in their entireties.

TECHNICAL FIELD

The disclosure relates to an electrical service switching device, e.g., a circuit breaker.

BACKGROUND INFORMATION

A service switching device of this generic type normally has a contact point which is formed by a fixed and a moving contact piece, with the moving contact piece being held on a contact lever which is mounted such that it can pivot. A service switching device of this generic type furthermore has a magnetic release with a magnet armature and a thermal release, as well as a switching mechanism, which can be tripped by the thermal and the magnetic release and has a latching point. This is formed by a tripping lever and a catch lever which is mounted in a fixed position such that it can rotate and has a elongated hole for guiding a clip. In the event of a short, the magnet armature can act on the contact lever, to which the moving contact piece is fitted, in order to open the contact point, and the switching mechanism can hold the contact lever permanently open. Furthermore, a service switching device of this generic type has a switching toggle for manual operation of the switching mechanism, and an intermediate lever, which is articulated at one of its ends with the contact lever and at its other end on the clip, with the clip being articulated by at least one limb on the switching toggle.

In service switching devices of this generic type, the force of a contact compression spring acts on the contact lever and is passed to the contact lever such that, when in the connected position, it presses the moving contact piece against the fixed contact piece, and in the disconnected position presses the moving contact piece away from the fixed contact piece.

The intermediate lever in this case represents the linking element between the switching mechanism and the contact lever.

In the connected position, the contact lever is held by the intermediate lever, which is blocked by the switching mechanism. A first, moving rotation point of the contact lever is blocked in a first position by the latched switching mechanism, such that the contact compression spring can press the contact lever against the fixed contact piece, around the first rotation point.

In the tripped or disconnected position, the intermediate lever is released from the switching mechanism. The switching mechanism is unlatched and releases the first rotation point of the contact lever, so that the contact compression spring can press the contact lever to the open position around a second fixed-position rotation point, in which open position the moving contact piece is at a distance from the stationary contact piece.

During thermal or short-circuit current disconnection, the switching mechanism is unlatched by the thermal or the electromagnetic release, acting on a tripping lever such that it can move from the connected state to the disconnected state. In the event of electromagnetic quick tripping, the magnet armature additionally knocks the moving contact lever away directly in order to quickly open the contact point, because disconnection by means of the unlatched switching mechanism would be slower than would be permissible for quick tripping, because of the mechanical inertia of the components involved.

Service switching devices of this generic type are known in which the switching mechanism is mounted with the contact lever in a prefabricated assembly between two boards, and can be inserted as an entity into the appliance while the appliance is being assembled. A tripping slide must then also be inserted after this, in order to couple the switching mechanism to the thermal and/or the magnetic release. EP 0144799 A1 discloses on example. Manufacturing tolerances during assembly of the board can in this case result in movements and tilting between the individual levers of the switching mechanism. When the contact lever is struck by the quick release during short-circuit tripping, then it strikes against a stop within the boards, so that the board parts can be moved further away from one another and, over time, the play between the various levers in the switching mechanism can become too great for precise operation. This can result in a lack of shape and position stability of the contact lever. Furthermore, the manufacture of the switching mechanism is quite complex, and it is costly to manufacture because of the sensitive tolerances and the riveted joints.

DE 10 2004 055 564 A1 discloses a service switching device having a switching mechanism whose individual parts are inserted successively into the housing, together with the contact lever. The switching mechanism with the contact lever is in this case no longer inserted as a prefabricated assembly but, so to speak, it grows within the housing. The thermal release and the contact lever are located on different sides, with respect to the magnetic release, so that, in this case as well, a tripping slide can be inserted separately, as an extension of the switching mechanism, between the thermal release and the switching mechanism.

This design is intended to be suitable for completely automatic manufacture that requires high-precision feeding and positioning of a large number of individual parts, thus making the automation production facilities highly complicated and expensive.

SUMMARY

A service switching device is disclosed of this generic type which can be manufactured with little effort both manually and fully automatically and, in the process, has high contact shape and position stability.

An electrical service switching device is disclosed, e.g., a circuit breaker, having a magnetic release with a magnet armature, a thermal release, a fixed and moving contact piece, a switching mechanism which can be tripped by the thermal and magnetic release and has a latching point which is formed by a tripping lever and a catch lever which is mounted in a fixed position such that it can rotate and has an elongated hole in order to guide a clip, wherein the magnet armature can act on the contact lever, to which the moving contact piece is fitted, in order to open the contact point in the event of a short, and the switching mechanism can hold the contact lever permanently in the open position, having a switching toggle for manual operation of the switching mechanism, and having an intermediate lever which is articulated at one of its ends with the contact lever and at its other end on the clip, wherein the clip is articulated with at least one limb on the switching toggle, wherein the contact lever forms a first assembly, which can be inserted in a prefabricated form into the housing of the service switching device and, after insertion into the housing, is mounted such that it can pivot on a rotation shaft which is connected to the housing at a fixed position, and wherein the switching toggle, together with the tripping lever, the catch lever, the intermediate lever and the clip forms a second assembly, which can be inserted in a prefabricated form into the housing and, after insertion, is connected in an articulated manner at a separation point to the first assembly.

BRIEF DESCRIPTION OF THE DRAWINGS

The disclosure as well as further exemplary embodiments and improvements of the disclosure will be explained and described in more detail with reference to the drawings, which illustrate one exemplary embodiment of the disclosure, and in which.

DETAILED DESCRIPTION

Figure 1:
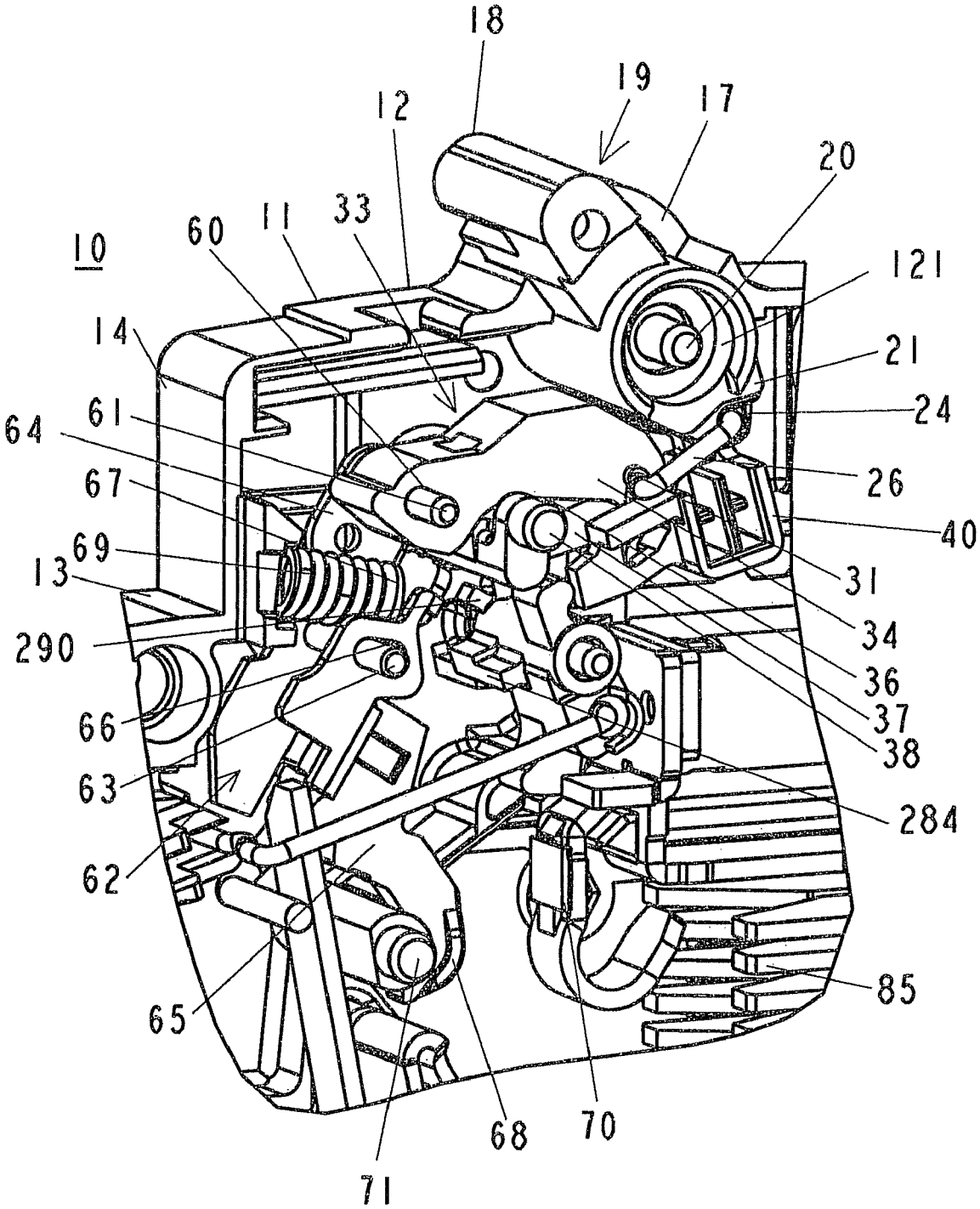
FIG. 1 shows a view into an exemplary service switching device according to the disclosure, with the contact point open.

Thus, according to the disclosure, the contact lever forms a first assembly, which can be inserted in a prefabricated form into the housing of the exemplary service switching device and, after insertion into the housing, is mounted such that it can pivot on a rotation shaft which is connected to the housing at a fixed position, and the switching toggle, together with the tripping lever, the catch lever, the intermediate lever and the clip forms a second assembly, which can be inserted in a prefabricated form into the housing and, after insertion, is connected in an articulated manner at a separation point to the first assembly. The second subject is also referred to in the following text as the joint chain.

According to one exemplary embodiment of the disclosure, the separation point is formed by a coupling point between a free end of the intermediate lever and a free end of the contact lever. By way of example, the coupling point may in this case be formed by a bolt which is integrally formed on a free end of the contact lever and engages in a recess which is incorporated at a free end of the intermediate lever.

The two assemblies can be manufactured and initially tested independently of one another. The separation of the functionality "switching mechanism with contact lever" into two assemblies results in each assembly on its own being less complex than an assembly having the entire functionality in a single assembly. Each of the two assemblies according to the disclosure can therefore be manufactured more easily and reliably. They are joined together at the separation point in the housing. During assembly, just two assemblies have to be inserted into the housing in order to provide the functionality. This can be done both easily by hand or by means of an automatic production facility. The requirements for the automatic production facilities are in this case clear since just two assemblies need be handled and positioned, rather than a multiplicity of individual parts.

According to one exemplary embodiment of the disclosure, the movement path of the contact lever in the open position can be limited by making contact with a stop which is connected to the housing in a fixed position. When the magnetic release strikes the contact lever in the event of a short, the stop absorbs the shock force of the contact lever. In consequence, the switching mechanism is not itself loaded with the shock force of the contact lever, thus avoiding displacement or movement between the individual levers which form the switching mechanism, thus resulting in a design with little play and which is permanently precise.

In a further exemplary embodiment, a service switching device according to the disclosure comprises a striking lever, which is mounted such that it can pivot in a fixed-position shaft and by means of which both the magnet armature and the thermal release act on the tripping lever. The striking lever therefore provides the coupling between the thermal or the magnetic release and the switching mechanism with the latching point. The thermal and the magnetic release can therefore be in the form of separate assemblies and can be inserted into the housing independently of one another, and after insertion of the contact lever and the joint chain.

In one exemplary embodiment of the disclosure, the striking lever may be a double-armed lever, in which case, in another exemplary embodiment, the magnet armature and the thermal release act on a first arm of the striking lever and pivot the latter while acting on it, such that the second arm of the striking lever acts on one arm of the tripping lever and pivots it such that the latching point between the tripping lever and the catch lever is unlatched.

During virtually every switching operation involving contact opening, irrespective of whether this is with a rated current load or in the event of a short, an arc is struck for a short time at the contact point and results in a small amount of local erosion on the moving and fixed contact pieces. Over the course of the life of a surface switching device of this generic type, this reduces the thickness of the contacts. The reduction in thickness is compensated for by the contact lever sinking thus resulting in a good area contact between the contact pieces even after the thickness of the contact pieces has been reduced. However, the closer the contact lever moves to the fixed contact piece as it sinks, the less is the contact pressure force which the contact compression spring can exert on the contact lever. Without an adequate contact pressure force, there is a risk of the contact resistance when the contact point is closed becoming too great, thus resulting in an unacceptable amount of heating at the contact point, and even in a series of small flashovers. In order to prevent this, the contact lever is prevented from sinking further once the contact piece thickness is less than a specific level.

In known service switching devices, either the contact pieces are designed to be very thick and therefore over-designed, or the sinking of the contact lever is limited by the length of the elongated hole in which the contact lever is mounted on the second, fixed-position rotation shaft. This is because, in the latched state, when the contact lever is pressed about the first rotation point against the fixed contact piece, the second, fixed-position rotation shaft is located in the inner area of the elongated hole. The less the thickness of the contact pieces becomes, the further the end of the elongated hole moves back towards the second, fixed-piece rotation shaft. When the second, fixed-piece rotation shaft finally makes contact with the edge of the elongated hole, the contact lever can no longer be pressed any further against the fixed contact piece, and the sinking process is stopped. However, the contact between the second, fixed-position rotation shaft and the edge of the elongated hole results in the contact pressure being reduced, so that the contact pressure force is actually reduced while still in the permissible sinking range. Secondly, the limit point for sinking may differ between individual appliances because of manufacturing tolerances in the stamping of the elongated hole.

In order to improve this situation, in another exemplary embodiment of the service switching device according to the disclosure, the sinking of the contact lever towards the fixed contact piece is limited by a fixed-position stop. In one exemplary embodiment of the disclosure, this stop can be formed by a housing projection. However, it can also be provided by a separate fitting which, however, is connected to the housing in a fixed position and in an interlocking manner or even integrally. The advantage of limiting the sinking process according to the disclosure by means of a fixed-position stop is that no contact pressure force is lost and the reproducibility of the limiting threshold can be improved from one appliance to another. According to the disclosure, the sinking process is not limited by the elongated hole but by a separate component, the stop. Its position and configuration can be optimized for its single function, thus resulting overall in an exemplary service switching device according to the disclosure having better characteristics.

In one exemplary embodiment of the disclosure, the position of the stop in the appliance corresponds to the movement path of the tripping lever such that the contact lever does not impede pivoting of the tripping lever when it is in contact with the stop.

First of all, reference will now be made to FIGS. 1 and 4.

An exemplary service switching device, in this case a circuit breaker which is annotated in its totality with the reference number 10 has a housing which is formed from two housing half-shells, of which only part of the first housing half-shell 11 is illustrated. Like the complementary second housing half-shell, which is not illustrated, this housing half-shell 11 has a facing front wall 12 and two rear front walls, of which only one rear front wall 13 can be seen in FIG. 1, which are connected to one another via front side walls, of which only one front side wall 14 can be seen in the figure. In addition, rear narrow-face walls which are part of the housing, as well as an attachment face and broad faces of the housing, are not shown in the illustration in FIG. 1.

It is, of course, also possible to use just one housing half-shell, which is closed by means of a cover. In the situation in which two housing half-shells are provided, each housing half-shell has a width which corresponds to half the standard module width. In the situation in which a single housing half-shell is closed by means of a cover, the housing half-shell is correspondingly a size which is chosen such that, together with the cover, it makes up the module width.

An opening 17 is located in the facing front wall 12, and the switching handle 18 of a switching toggle 19 projects through this opening 17. The switching toggle 19 has an opening which may be regarded as a virtual rotation shaft for the switching toggle. There are two projections 21, 22 in the form of forks integrally formed on the side diametrically opposite the switching handle 18, only one projection 21 of which can be seen in the illustration in FIG. 1. Both of the projections 21, 22 which are integrally formed in the form of a fork can be seen in the perspective illustration in FIG. 6*d*. The two projections 21, 22 leave an accommodation area 23, which is open on one side, free between them. Each of the two projections 21, 22 has an opening 24, 25 in the form of an eye at its end averted from the switching handle 18. The longitudinal centre axis of the switching handle 18 passes through the centre point of the openings 24, 25 which are in the form of eyes.

Figure 4:
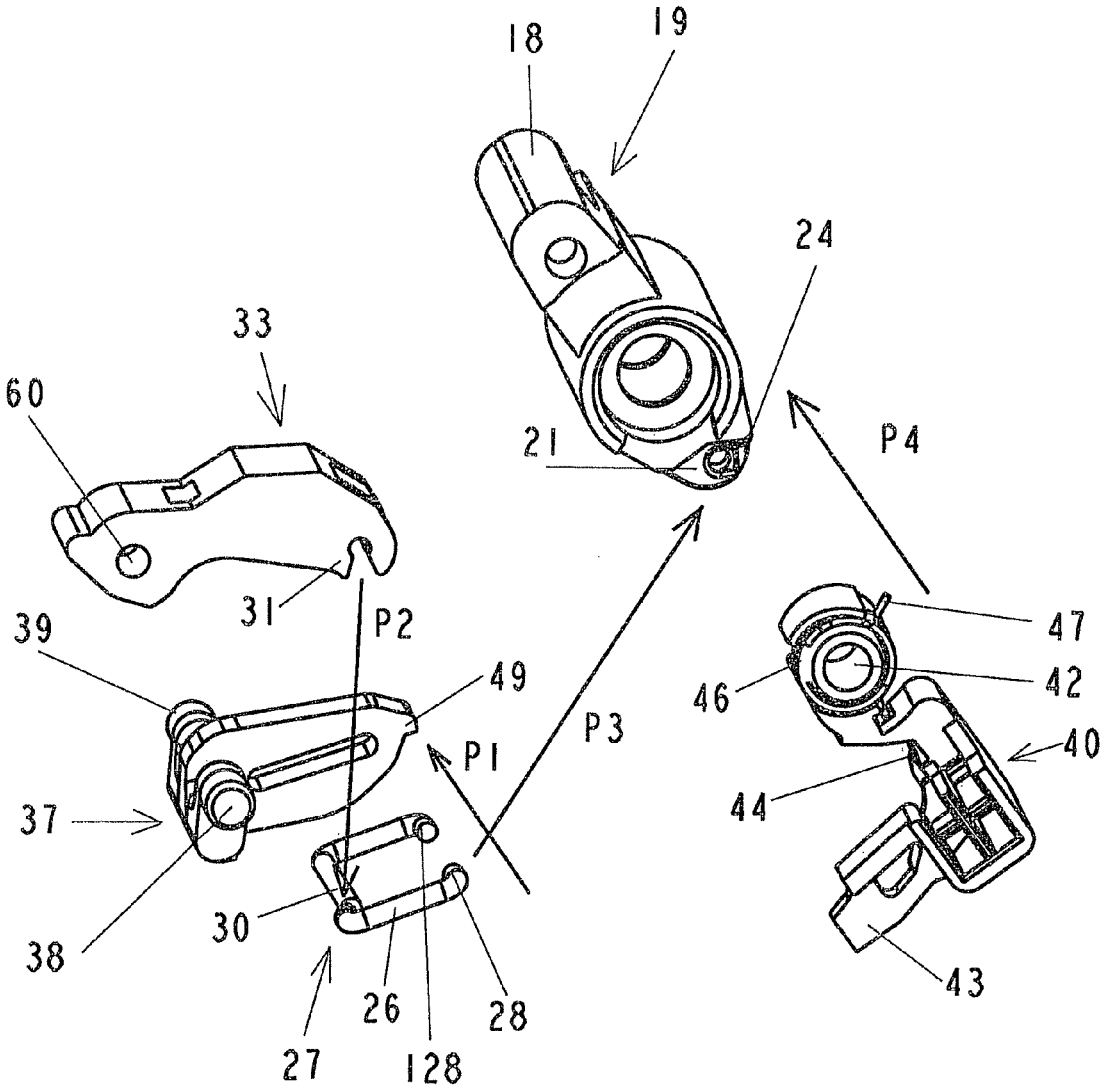
FIG. 4 shows an exploded illustration of the joint chain.
Figure 5:
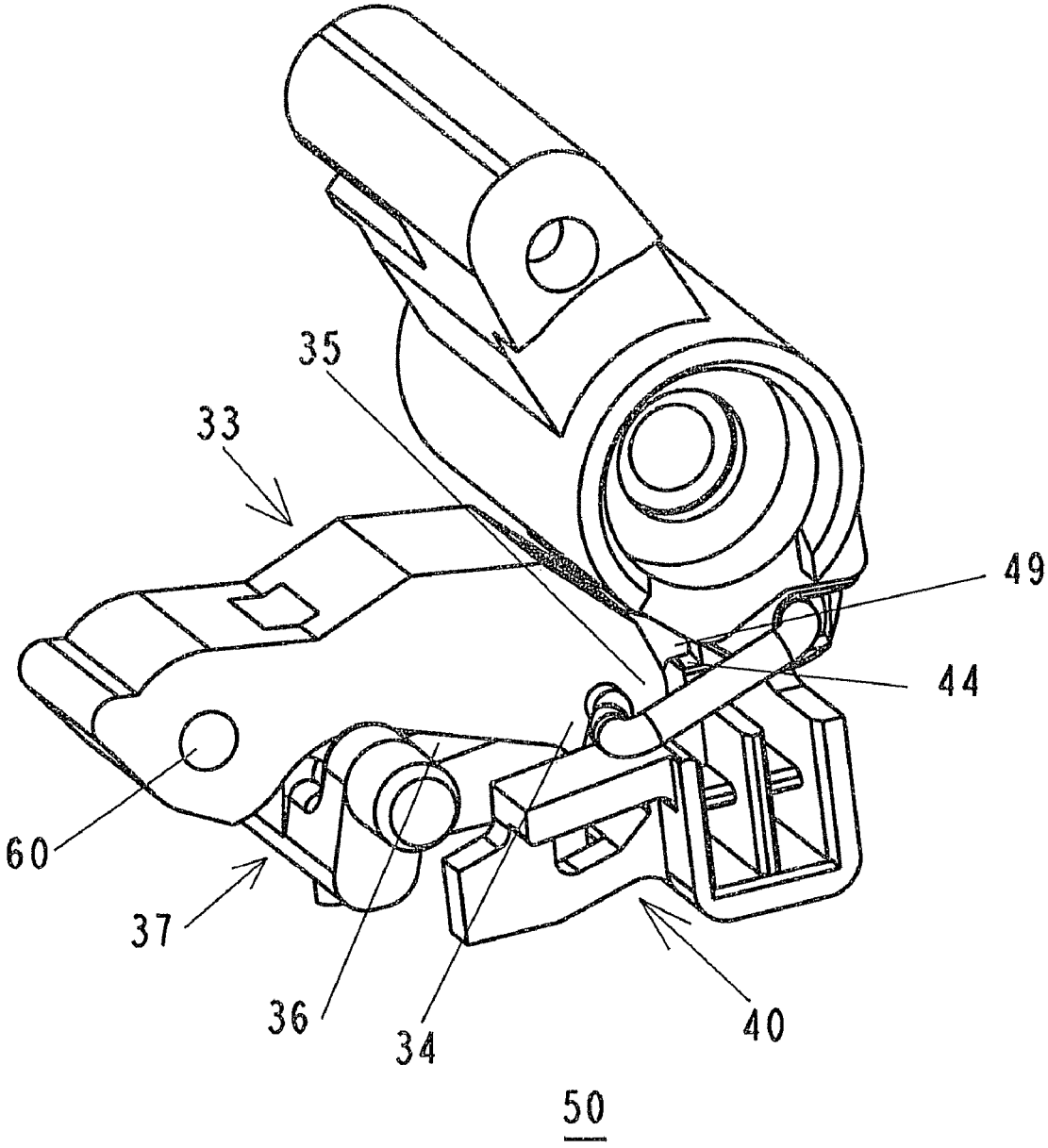
FIG. 5 shows the assembled joint chain as shown in FIG. 4.

One limb 26 of a U-shaped clip 27 engages with its integrally-formed guide projection 28 in the opening 24 which is in the form of an eye, as is illustrated in detail in FIG. 4. The second limb 29 of the clip 27 engages with its guide projection 128 in the opening 25, which is in the form of an eye, in the second projection 22 on the switching toggle 19.

The clip web 30, which connects the two U-limbs 26, 29, of the clip 27 engages in two latching openings 31, 32 in an intermediate lever 33. The intermediate lever 33 for this purpose has, at one of its ends, a U-profile which ends in two projections 34, 35 arranged in the form of a fork, with each of the two projections 34, 35 which are arranged in the form of a fork having a respective latching opening 31, 32 at the end.

At the same time, the clip web 30 engages in an elongated hole 36 in a latching lever 37, which is arranged underneath the intermediate lever 33 and runs partially in the U-profiled recess between the two projections 34, 35 at the end of the intermediate lever 33, passing through it. The clip web 30 of the U-shaped clip 27 is therefore guided in the elongated hole 36 in the catch lever 37, and the intermediate lever 33 is at the same time articulated with its latching openings 31 and 32 on the clip web 30. The switching toggle 19, the intermediate lever 33 and the catch lever 37 therefore form a unit, by being coupled together by the clip 27.

A pin 38, 39 is respectively integrally formed on the two sides of the catch lever 37, by means of which the catch lever 37 is mounted in a fixed position, such that it can rotate, in both housing half-shells in the case of a two-shell housing, or in the housing shell and the cover in the case of a single-shell housing with a cover.

The longitudinal external direction of the intermediate lever 33, of the catch lever 37 and of the limbs 26, 29 of the clip 27 runs parallel to the broad face of the appliance housing.

A tripping lever 40 is mounted such that it can rotate above a fixed-position shaft 20. This tripping lever 40 is approximately L-shaped, see FIG. 6, with its first arm 41 having a joint head with an opening 42 in the form of an eye at its free end, by means of which opening 42 it is mounted on the fixed-position shaft 20 such that it can rotate. Its second arm 43 is integrally formed approximately at right angles on the first arm 42. The first arm 41 has a latching surface 44 approximately in its centre.

The first arm 41 of the tripping lever 40 has a latching tab 45 on the annular end face of the opening 42, which is in the form of an eye. The first arm 41 of the tripping lever 40 is inserted into the accommodation area 23 between the two projections 21, 22, on the switching toggle 19, which form a fork, such that the centre axis of its opening 42, which is in the form of an eye, coincides with the centre axis of the opening in the switching toggle 19. In this case, the opening in the switching lever is seated on a bead 120 which surrounds the opening 42 (which is in the form of an eye) and on which it is held such that it can rotate. The tripping lever 40 is held on the shaft 20 such that it can pivot, and the switching toggle 19 is held on the tripping lever 40 such that it can pivot.

The latching tab 45 holds a spring 46 firmly.

In this way, the tripping lever 40 is added to the unit formed by coupling the switching toggle 19, the intermediate lever 33 and the catch lever 37 by means of the clip 27.

Figure 3:
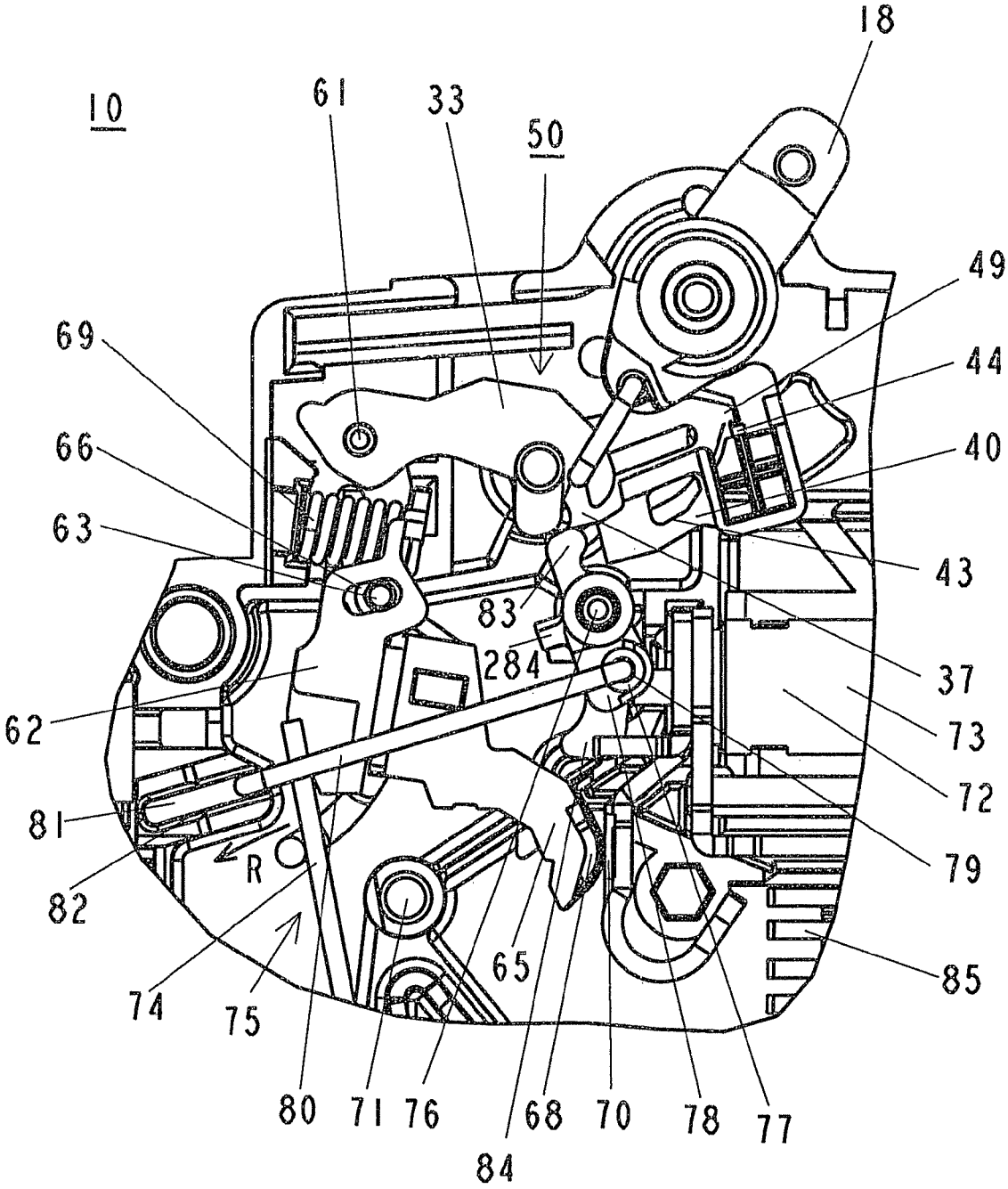
FIG. 3 shows a view into an exemplary service switching device according to the disclosure, with the contact point closed.

The catch lever 37 is fitted at one of its free ends with a tab 49 which, together with the latching surface 44 on the tripping lever 40, forms the latching point for the switching mechanism when the tripping lever 40 is in the latched position. FIG. 3 shows the circuit breaker 10 with the switching mechanism latched. In the latched position, the tripping lever 40 is pivoted in the clockwise direction towards the catch lever 37 in the view shown in FIG. 3.

A prestressed spring arrangement 46 with two projecting arms 47, 48, of which the arm 47 acts on the switching toggle 19 and the arm 48 acts on the tripping lever 40, act on the tripping lever 40 in the direction of its latched position, that is to say in the clockwise direction in the illustration shown in FIG. 3, holding it firmly in the latched position without any opposing force acting on it.

The tripping lever 40, the switching toggle 19, the intermediate lever 33 and the catch lever 37 thus form an integral unit which can be prefabricated and is also referred to in the following text as the joint chain 50. The joint chain 50 can be prefabricated and initially tested as a separate unit.

Reference will now be made to FIG. 4, which illustrates the individual steps for assembly of the joint chain 50, in the form of an exploded drawing. In the first step, which is denoted by the arrow P1, the one limb 29 of the clip 27 is passed through the elongated hole 36 such that the clip web 30 is guided such that it can move in the elongated hole 36, and the catch lever 37 runs between the two limbs 26, 29 of the clip 27. In the second step, denoted by the arrow P2, the end latching openings 31 in the intermediate lever 33 are clipped onto the clip web 30 such that its end projections 34, 35 cover and surround the catch lever 37. In the third step, denoted by the arrow P3, the guide steps 28, 128 which are integrally formed at the end on the limbs 26, 29 of the clip 27 are inserted into the openings 24, 25, which are in the form of eyes, in the projections 21, 22 of the switching toggle 19. Finally, in the fourth step denoted by the arrow P4, the tripping lever into which the spring arrangement 46 has previously been inserted is inserted into the accommodation area 23 between the projections 21, 22 which are fitted in the form of a fork to the switching toggle 19, and is latched therein.

FIGS. 6*a* to 6*d* show further details of the spring arrangement 46 and of the assembly of the joint chain 50. In this case, the spring arrangement 46 is a spiral spring which is pushed onto the external circumferential surface of the joint head in the area of the joint head of the free end of the first arm 41 of the tripping lever 40. The joint head is fitted with a step 51, which is circumferential approximately centrally on its external circumferential surface and is used as a stop for the spiral spring of the spring arrangement 46. A cover surface 52 in the form of a shell extends from the step 51 towards the end face of the joint head, so that a gap for holding and guiding the spring arrangement 46 is formed between the external circumferential surface of the joint head and the cover surface 52. The end face of the cover surface 52 runs in the form of an incline 53 from the stop edge of the step 51 to the end face of the opening 42, which is in the form of an eye, where it ends in an undercut in such a way that a holding pocket 54 is formed for the spring arm 47 of the spring arrangement 46.

Figure 6A:
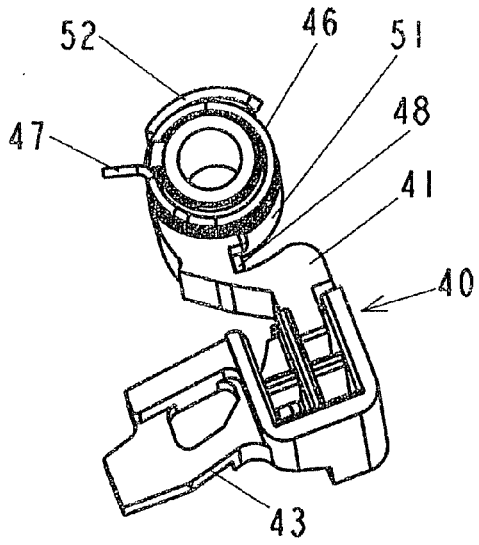
FIGS. 6*a-d* show individual assembly steps during insertion of the tripping lever into the switching toggle.
Figure 6B:
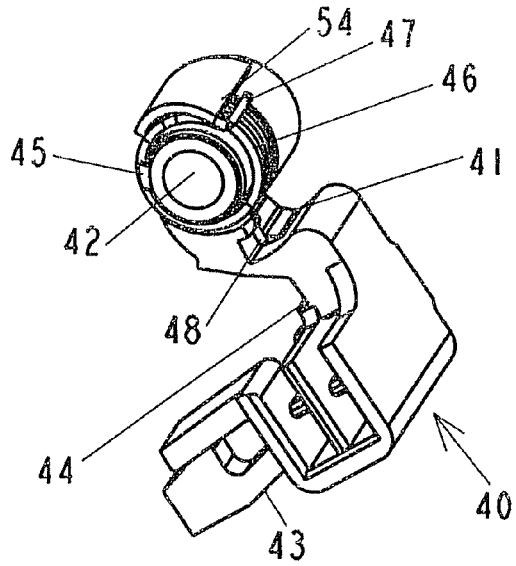
Figure 6C:
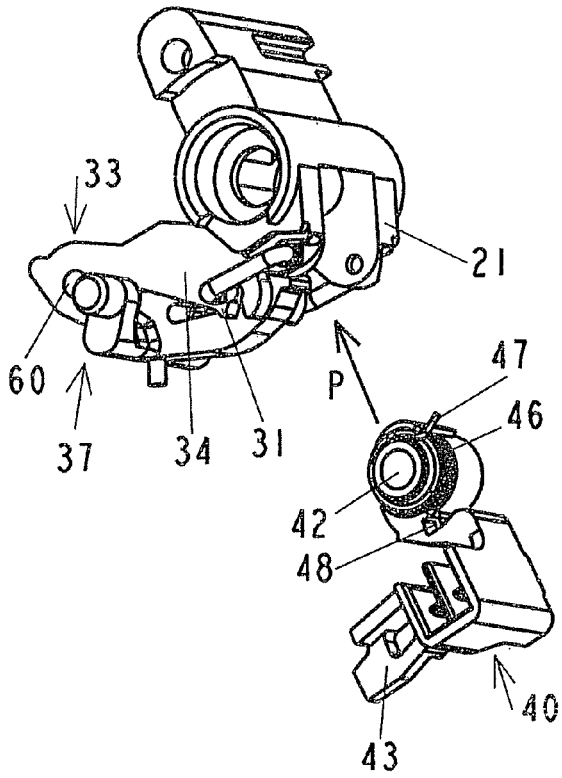
Figure 6D:
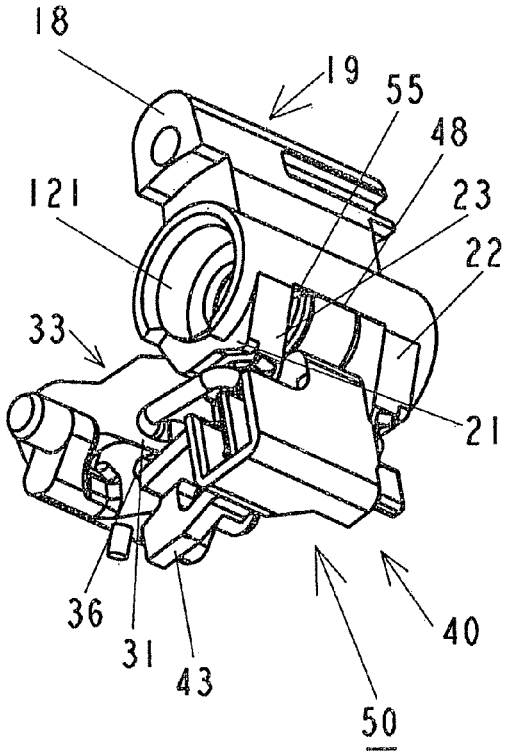

As is shown in FIG. 6*a*, the spring arrangement 46 is therefore pushed onto the external circumferential surface of the opening 42, which is in the form of an eye, such that the projecting spring arm 48 is held in a further undercut on the first arm 41 of the tripping lever 40. The second projecting spring arm 47 is approximately at right angles to the first projecting spring arm 48 when there is no load on the spring arrangement 46. In order to prestress the spring arrangement 46, the second projecting spring arm 47 is pivoted in the clockwise direction along the incline 53 until it latches in the holding pocket 54. The spring arrangement 46 is now prestressed. As shown in the illustration in FIG. 6*c*, the tripping lever 40 is now pushed with the prestressed spring arrangement 46, from which the second spring arm 47 now projects radially, into the accommodation area 23 between the two projections 21, 22 on the switching toggle 19. At the same time, the second projecting spring arm 47 is supported on the centre web 55, which runs between the two projections 21, 22, of the switching toggle 19.

The joint chain 50 is thus assembled, its individual parts are coupled to one another in an articulated manner, and the tripping lever 40 is prestressed in its latching direction by the spring arrangement 46.

Reference will now be made once again to FIG. 1. The intermediate lever 33 has a recess 60 at its end averted from the clip 27. It is connected by means of a cylindrical pin 61 to the contact lever 62 in an articulated manner adjacent to this recess.

The contact lever 62 is a double-armed lever and is mounted such that it can rotate in an elongated hole 66 in a shaft 63 which is connected in a fixed position to the first housing half-shell 11, such that a first lever element 64 points towards the facing front wall 12 from the fixed-position shaft 63, and a second lever element 65 points in the direction of the attachment face of the housing from the fixed-position shaft 63. At its free end, the first lever element 64 is fitted with the pin 61, which is connected to it in an interlocking manner. The pin 61 therefore forms the coupling point between the joint chain 50 and the contact lever 62.

The first lever element 64 has a U-shaped contour with an accommodation area 67 which is formed by the limbs, (which run approximately parallel to the broad faces of the housing) and opens in the direction of the front side wall 14, and one of whose limbs has a recess such that the accommodation area 67 is accessible from the broad face of the removed housing half-shell, when the housing is open.

The free end of the second lever element 65 is fitted with the moving contact piece 68.

In the disconnected position, as illustrated in FIG. 1, a contact compression spring 69 (one end of which is supported on the front side wall 14 of the housing and whose second end is supported in the accommodation area 67 in the first lever element 64) presses the contact lever 62 in the clockwise direction around the fixed-position shaft 63 so that the moving contact piece 68 is forced away from the fixed contact piece 70. During this process, the movement path of the contact lever 62 is limited by a stop 71 which is connected in a fixed position to the first housing half-shell, in other words with the contact lever 62 resting on the fixed-position stop 71 in the disconnected position. The fixed-position stop 71 is formed by a bolt which is integrally connected to the housing half-shell and, for example, can be produced together with the housing half-shells in an injection-moulding process.

Reference will now be made to FIG. 3, which shows the circuit breaker in the connected position. The switching handle 18 is in the connected position, and the latching surface 44 of the tab 49 on the catch lever 37 is latched on the tripping lever 40. The intermediate lever is therefore blocked, and the pin 61 at the coupling point between the joint chain 50 and the contact lever 62 now forms the rotation axis for the contact lever 62. The contact compression spring 69 pushes the contact lever 62 in the anticlockwise direction around this axis 61, thus ensuring the contact between the moving contact piece 68 and the fixed contact piece 70.

The figure also shows the coil 72 of the magnetic release 73 and a strip 74 in the form of a thermal bimetallic strip or composed of shape memory alloy as part of the thermal release 75. In the arrangement as shown in FIGS. 1 and 3, the contact lever 62 and the contact point which is formed from the moving and the fixed contact pieces 68, 70 are located between the magnetic release 73 and the thermal release 75. In other words, the magnetic release 73 and the thermal release 75 are located on different sides of an imaginary plane which runs through the contact lever 62 and is at right angles to the first housing half-shell 11.

On tripping, the magnetic release 73 or the thermal release 75 should open the latching point formed by the tab 49 on the catch lever 37 and the latching surface 44 on the tripping lever 40, such that the switching mechanism is unlatched in this way and the contact lever 62 can be moved by the contact compression spring 69 to the disconnected position, as illustrated in FIG. 1. To do this, the magnetic release and the thermal release must be mechanically coupled to the tripping lever 40. In the exemplary embodiment of the present disclosure as illustrated in FIGS. 1 and 3, the mechanical coupling between the magnetic release 73 and the tripping lever 40, and between the thermal release 75 and the tripping lever 40, is provided by means of a striking lever 77 which is mounted in a fixed position such that it can rotate.

A striking lever 77 in the form of a double-armed lever is for this purpose mounted such that it can pivot on a further shaft 76, which is connected in a fixed position to the housing half-shell 11.

A first arm element 78 of the striking lever 77 points from the fixed-position shaft 76 in the direction of the attachment face of the housing. It has an opening 79 which is in the form of an eye and in which a first limb of a transmission clip 80 is held such that it can move.

The second limb of the transmission clip 80 is guided such that it can move in a guide groove 81 in the housing. The side walls 82 of the guide groove 81 are in this case made sufficiently deep and the second limb of the transmission clip 80 is correspondingly designed to be sufficiently long that the strip 74 of the thermal release 75 can move over the side walls 82 of the guide groove 81 when it is bent on heating in the direction of the arrow R, that is to say in this case in the anticlockwise direction, and in the process drives the second limb of the transmission clip 80 in the direction of the arrow R.

By means of the tensile force, the transmission clip 80 pivots the striking lever 77 in the clockwise direction, and in consequence its second arm element 83 acts on the tripping lever 40 such that it is pivoted against the force of the spring arrangement 46 and in the anticlockwise direction, such that the latching surface 44 moves away from the tab 49, thus unlatching the latching point.

A corresponding situation occurs in the event of magnetic tripping. When a short-circuit current occurs, a striking pin which is driven by the armature of the magnetic release emerges from an opening on the end face of the magnetic release 73, facing the striking lever 77, and strikes the first arm element 78 of the striking lever 77. Since it is struck from right to left, it also pivots the striking lever 76 in the clockwise direction, thus unlatching the latching point.

The striking lever 76 also has a tab 84 which projects in the direction of the second lever element 65 of the contact lever 62. When the striking pin now pivots the striking lever 77 in the clockwise direction on magnetic tripping, then the tab 84 strikes the contact lever 62 once the latching point has been unlatched, and knocks it to the disconnected position shown in FIG. 1. During this process, the moving contact piece 68 is torn away from the fixed contact piece 70, resulting in an arc which is quenched in an arc quenching device, which in this case is annotated with the reference number 85 in the figures, but only part of which is indicated. In an known manner, the arc quenching device has an arc quenching splitter stack with an initial chamber area which can be bounded by initial chamber covering plates parallel to the housing broad faces, and towards which the arc is passed by means of two arc guide rails.

The striking movement of the contact lever 62 is in this case limited by the fixed-position stop 71.

The advantage of using the fixed-position stop 71 for limiting is that the shock force which is transmitted from the striking pin to the contact lever 62 is absorbed by the housing and not by parts of the switching mechanism. This avoids excessive mechanical loads on the switching mechanism parts, likewise preventing load-dependent distortion and movement of the switching mechanism parts and maintaining a mutual arrangement and position of the individual parts of the switching mechanism within the tight tolerance limits that are required for reliable operation. In particular, this ensures that the contact opening movement is defined and can be set accurately, and does not change over the course of time as a result of mechanical distortion.

A second projection or a second tab 284 is located on the striking lever 77 in the vicinity of the fixed-position shaft 76, pointing towards the contact lever 62. The second tab 284 is used to limit the pivoting movement of the striking lever 77 when it is pivoted in the clockwise direction in the event of thermal or magnetic tripping. A second stop 290 is integrally formed in a fixed position on the inside of the housing broad face for this purpose, see FIG. 1.

The longitudinal extent direction of the striking lever 77 lies approximately on an imaginary plane which is at right angles to the housing half-shell 11 and runs through the contact point formed from the moving and the fixed contact pieces 68, 70. This makes it possible to provide a very compact and space-saving mutual arrangement for the assembly elements comprising the switching mechanism, the magnetic release, the thermal release, and the contact lever of the contact point.

The switching mechanism, the contact lever 62 with the contact point, the thermal release 75 and the striking lever 77, that is to say virtually all the mechanically moving parts, are arranged jointly in a first half-area of the housing, which extends from an imaginary centre plane, which runs at right angles to the housing broad faces through the centre point of the shaft 20 of the switching toggle 19, to a narrow face of the housing. The arc quenching device 85 and the magnetic release 73 are accommodated in another half-area of the housing, which extends from the imaginary centre plane to the opposite narrow face of the housing.

In the connected position, as shown in FIG. 3, an angle of approximately 90° is formed between the transmission clip 80 and the first arm element 78 of the striking lever 77. An angle of approximately 90° is likewise formed between the second arm 43 of the tripping lever 40 and the second arm element 83 of the striking lever 77. Furthermore, the first arm element 78 and the second arm element 83 of the striking lever 77 are approximately of the same length. The lever arrangement designed in this way ensures very effective force transmission from the strip 74 of the thermal release 75 via the transmission clip 80 and the striking lever 77 to the tripping lever 40, because the lever ratio of 1:1 and the angle of 90° that are provided result in the tension force being transmitted from the transmission clip 80 to the tripping lever 40, without being reduced.

Figure 2:
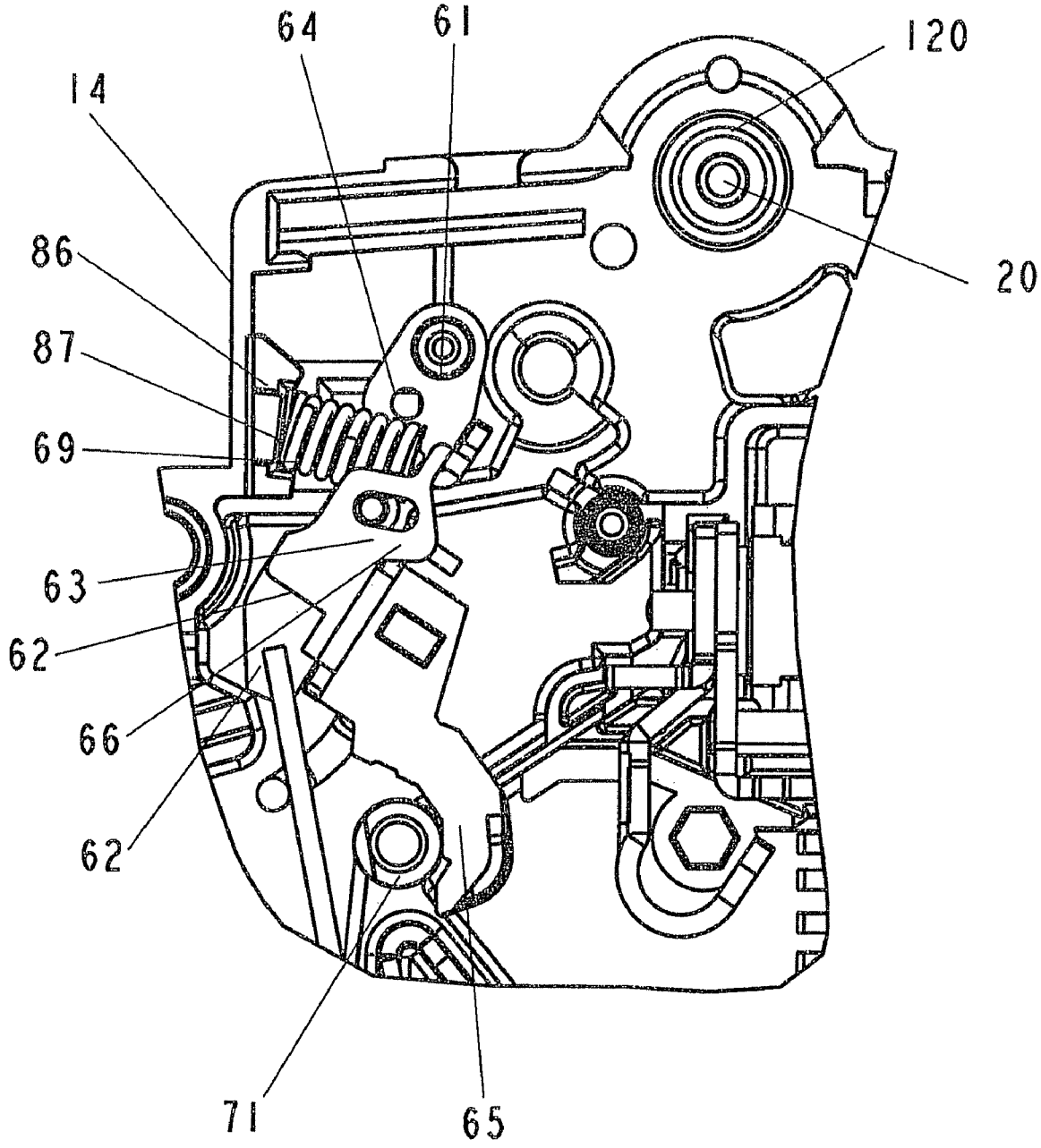
FIG. 2 shows the same view as in FIG. 1, in a state of manufacture in which the joint chain has not yet been inserted.

Reference will now be made to FIG. 2, which illustrates an assembly step in which the contact lever 62 with the contact compression spring 69 has already been inserted into the housing, but the joint chain 50 has not yet been inserted. The assembly process is carried out by the elongated hole 66 in the contact lever 62 being articulated on the fixed-position shaft 63. The contact compression spring 69 is then inserted. During this process, it is helpful that the first lever element 64 of the contact lever 62 has a recess on one of its limbs of the U-shaped contour. This allows the contact compression spring 69 to be inserted in a simple manner at right angles to the housing broad face into the accommodation area 67 in the first lever element 64, and in particular this simplifies automated assembly. On the housing side, the contact compression spring 69 is supported on a wedge-shaped projection 86 on the front side wall 14, with the inclination of the supporting surface 87 with respect to the front side wall 14 being chosen such that, when the contact lever 62 is in the connected position, it runs approximately parallel to the web of the first lever element 64 on which the contact compression spring 69 is supported on the contact lever side, so that the contact compression spring 69 runs largely in a straight line between the front side wall 14 and the contact lever 62 when the contact lever 62 is in the connected position. This ensures that forces are transmitted well from the contact compression spring 69 to the contact lever 62, and therefore ensures a high contact pressure force at the contact point.

In the assembly step illustrated in FIG. 2, the contact compression spring 69 presses the second arm element 65 of the contact lever against the stop 71. The contact lever 62 is therefore in a clearly fixed and stable position. This is important since it simplifies the next assembly step of insertion of the joint chain 50. The joint chain 50 is now inserted in such a way that it is mounted in an articulated manner such that it can pivot on one hand on the fixed-position shaft 20 and also with the recess 60 in the intermediate lever 33 on the pin 61 of the contact lever 62.

The clearly fixed position of the contact lever 62 considerably simplifies the insertion process, especially for automated assembly.

Once the joint chain 50 has been inserted, the striking lever 77 is finally also fitted to the fixed-position shaft 76, and the first limb of the transmission clip 80 is inserted into the opening 79 in the first arm element 78 of the striking lever 77, and its second limb is inserted into the guide groove 81, which is connected to the housing in a fixed position.

Overall, the exemplary service switching device according to the disclosure is therefore configured to be highly convenient for assembly. Since the design according to the disclosure avoids large shock forces being transmitted from the contact lever to the joint chain, in particular when the contact point is struck in the event of a short circuit, the joint chain (with the exception of the spring arrangement 46) can be manufactured from plastic parts which can be plugged and clipped together in a simple manner. There is no need to provide screwed, soldered, welded or riveted joints, as are still always necessary in comparable appliances according to the prior art.

Figure 7:
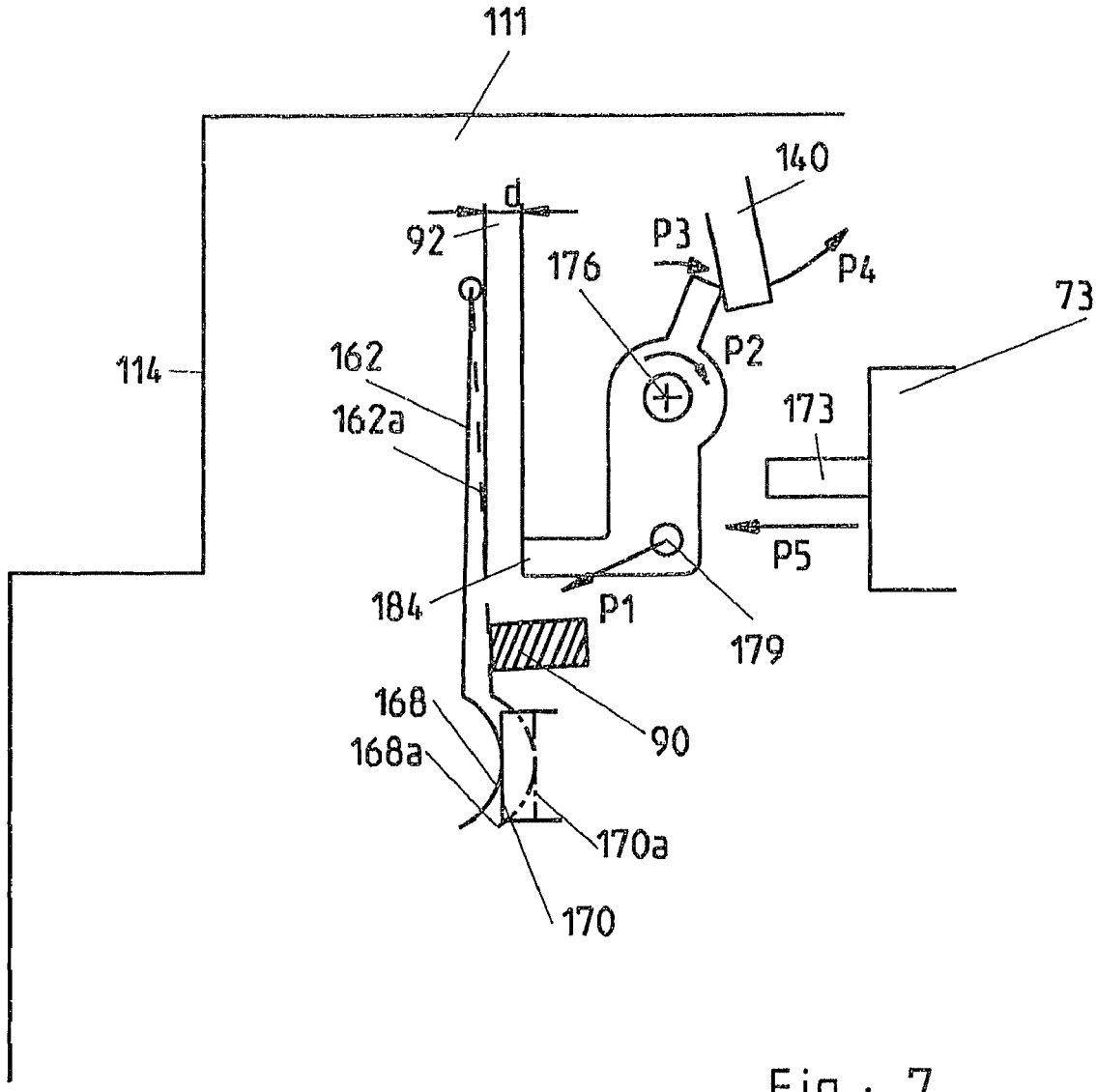
FIG. 7 shows a schematic illustration of the sinking of the contact lever being limited by a fixed-position stop.

Reference will now be made to FIG. 7, which shows another exemplary service switching device according to the disclosure, illustrated schematically, in which the sinking of the contact lever 162 towards the fixed contact piece 170 in the situation in which the thickness of the fixed and/or moving contact pieces 168, 170 is being greatly reduced as a result of erosion is limited by a stop 90 which is connected in a fixed position to the housing half-shell 111. The stop 90 is in the form of a housing projection which projects into the interior of the housing at the appropriate point, and is produced during the production of the housing half-shells by injection moulding, together with all the other housing attachments, in one injection-moulding process. It could also be formed by a separate fitting, but which is connected to the housing in a fixed position and in an interlocking manner, or even integrally.

The reference numbers 162, 168, 170 denote the contact lever, the moving contact piece and the fixed contact piece when the contact point is closed, and without the thickness having been reduced by erosion. The reference numbers 162*a*, 168*a*, 170*a*, represented by dashed lines, show the contact lever, the moving contact piece and the fixed contact piece when the contact point is closed, and with the thickness having been reduced by erosion. As can be seen, when severe erosion has occurred, the contact lever 162*a* is located closer to the striking lever 177 when the contact point is closed, than when there is no erosion. The contact pressure force from the contact compression spring (not illustrated in FIG. 7) is decreased because the distance between the contact lever 162*a* and the front side wall 114 on the housing has become greater in this case. The stop 90 reduces this sinking of the contact lever 162*a* to values at which the contact compression spring still always ensures that the contact pressure force is sufficiently high. As the erosion becomes even greater, the contact point can no longer be closed, and the switching device must be replaced. It is therefore impossible for a switching device to be in use whose contact point is admittedly closed but whose contact pressure force is inadequate. This is because, in this situation, the contact resistance at the contact point would be increased, with the risk associated with this of unacceptable heating of the switching device.

Until it makes contact with the stop, the contact compression spring acts on the contact lever without any impediment. The advantage of using the fixed-position stop to limit the sinking movement according to the disclosure is that no contact pressure force is lost and improved reproducibility of the limiting threshold from one appliance to another can be achieved.

The position of the stop 90 relative to the striking lever 177 is in this case chosen such that, when the contact lever 162*a* is in contact with the stop 90, there is still a sufficiently large striking distance 92 between the contact lever 162*a* and the tab 184 on the striking lever 177, which is mounted in its fixed-position shaft 176 such that it can pivot. In this case, the striking distance 92 is sufficiently great that, in the event of thermal tripping, that is to say when the transmission clip is moved in the direction of the arrow P1 in the opening 179 in the striking lever 177, the striking lever 177 can still pivot sufficiently clockwise in the direction of the arrow P2 in order to act on the tripping lever 140 such that it can pivot this in the direction of the arrow P4, in the anticlockwise direction, in order in this way to open the latching point of the switching mechanism.

In one variant, the striking lever 177 could also be split along an imaginary plane parallel to the housing broad faces. The inner part, which faces the first housing half-shell 111, then corresponds to the part illustrated in FIG. 7 and annotated with the reference number 177. This is fitted with the tab 184, on which the striking pin 173 of the magnetic release 73 acts in the direction of the arrow P5 in the event of magnetic tripping. In this variant, the tab 184 can then rest directly on the contact lever 162*a* without having to maintain a striking distance. This is because the mechanical coupling to the thermal release would be provided by an outer part of the striking lever which is at the required striking distance 92 and is mounted such that it can be pivoted or moved relative to the inner part of the striking lever. This is because the striking distance is in fact required only in order to allow the striking lever to be pivoted by the transmission clip, which acts in the opening 179, in the event of thermal tripping. In this case, the second arm elements of both the outer and the inner part of the striking lever act on the tripping lever 140 in order to open the latching point of the switching mechanism for tripping.

The advantage of this variant with a split striking lever is that the contact point is struck more quickly when magnetic tripping occurs, because the striking lever 177 no longer need first of all move through the striking distance 92 in order to strike the respective contact lever 162 or 162*a*.

A further variant, although this is not illustrated in the figures, is for the striking lever 177 to transmit only the movement of the striking pin 173 of the magnetic release 73 to the contact lever 162 or to the tripping lever 140 while, in contrast, the movement of the thermal release is transmitted directly via a transmission clip to the tripping lever, that is to say without the interposition of the striking lever, with the arrangement of the joint chain and of the contact lever otherwise being unchanged from that shown in FIGS. 1 to 3. In this variant, the transmission clip no longer acts as a tension clip but as a compression clip. In this variant, the thermal release must be designed such that it bends in the direction towards the contact point when heated. In the exemplary embodiment shown in FIGS. 1 to 3, the strip 74 of the thermal release 75 in fact bends in the direction away from the contact point on heating.

Figure 8:
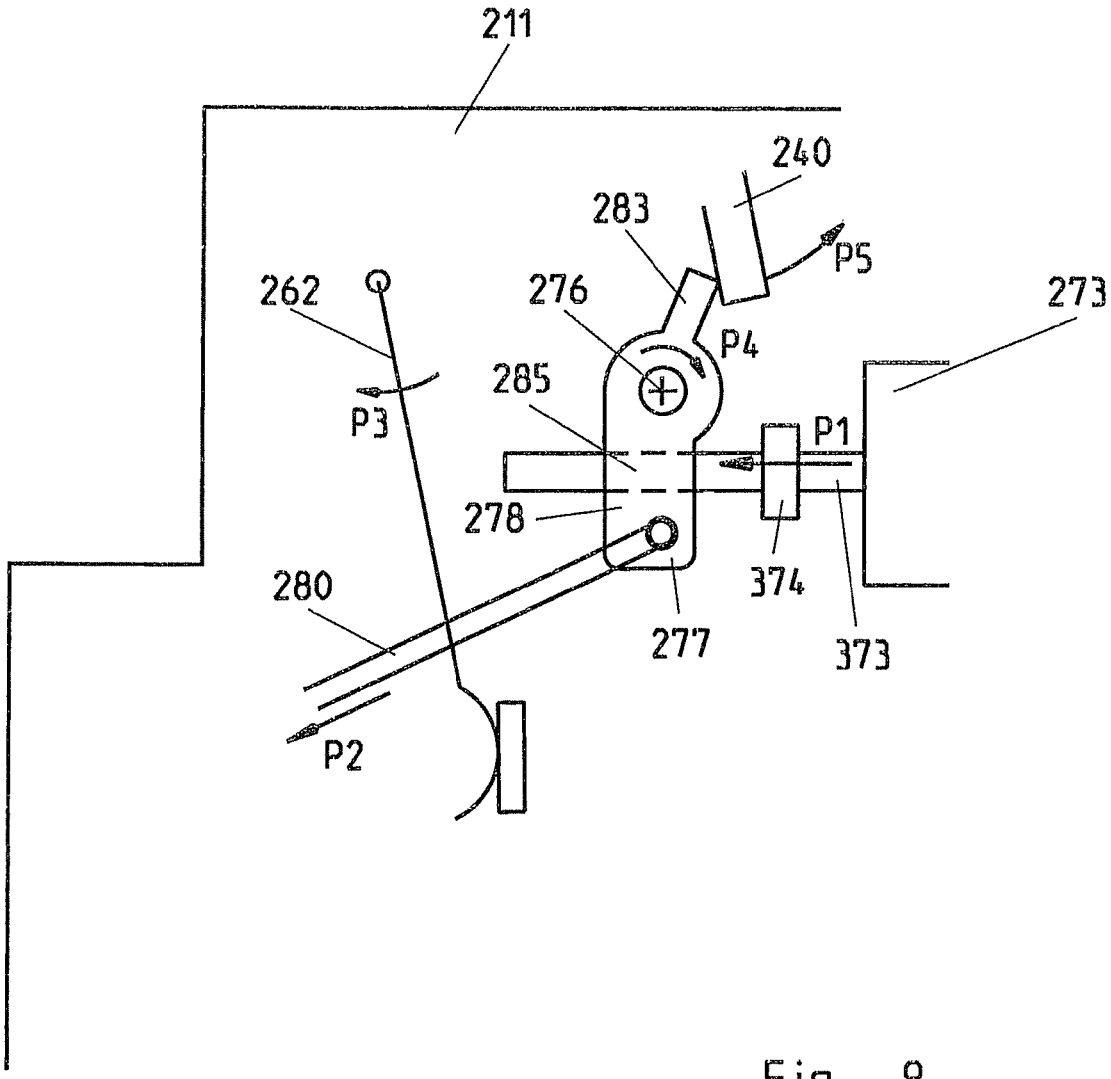
FIG. 8 shows a schematic illustration of the interaction of the striking pin with the striking lever, and its direct effect on the contact lever.

FIG. 8 shows yet another variant of the mechanical coupling of the thermal and magnetic releases 75, 73 to the tripping lever. In this case, the contact point is struck directly by the striking pin 373 of the release 273 without having to pass through the striking lever 277. However, in this case as well, the latching point is unlatched by the tripping lever 240 with the interposition of the striking lever 277. This results in the contact point being open very quickly and directly in the event of a short.

The striking lever 277 has an aperture 285 through which the striking pin 373 of the magnetic release 273 passes. A circumferential collar 374 is integrally formed on the striking pin 373 in the area between the end face of the magnetic release 273 and the striking lever 277. If the striking pin 273 is now accelerated in the direction of the arrow P1 towards the striking lever 277, driven by the armature of the magnetic release 273, in the event of a short-circuit current, then the collar 374 first of all strikes the first arm element 278 of the striking lever 277, which results in the latter being pivoted about its fixed-position shaft 276 in the direction of the arrow P4 in the clockwise direction, and its second arm element 283 pivoting the tripping lever 240 in the direction of the arrow P5, in the anticlockwise direction, thus unlatching the latching point of the switching mechanism.

Driven by the striking lever 277, the striking pin 373 then moves further until it makes contact with the contact lever 262 and knocks it to the open position in the clockwise direction, in the direction of the arrow P3.

In the event of thermal tripping, the movement of the strip of the thermal release is transmitted via a transmission clip 280 in the tension direction of the arrow P2 to the striking lever 277, where it is likewise converted to pivoting of the striking lever 277 in the clockwise direction. In this situation, the striking lever 277 has no tab facing the contact lever 262 since, as in the case of the other embodiments described above, it is in fact only used, with the striking lever, to also strike the contact lever.

It will be appreciated by those skilled in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

List of reference symbols

| | |
|---|---|
| 10 | Circuit breaker |
| 11, 111, 211 | First housing halfshelf |
| 12 | Facing front wall |
| 13 | Rear front wall |
| 14, 114 | Front side wall |
| 17 | Opening |
| 18 | Switching handle |
| 19 | Switching toggle |
| 20 | Fixed-position shaft |
| 21 | Projection |
| 22 | Projection |
| 23 | Accommodation area |
| 24 | Eye-shaped opening |
| 25 | Eye-shaped opening |
| 26 | Limb |
| 27 | Clip |
| 28, 128 | Guide projection |
| 29 | Limb |
| 30 | Clip web |
| 31 | Latching opening |
| 32 | Latching opening |
| 33 | Intermediate lever |
| 34 | Projection |
| 35 | Projection |
| 36 | Elongated hole |
| 37 | Catch lever |
| 38 | Pin |
| 39 | Pin |
| 40, 140, 240 | Tripping levers |
| 41 | First arm |
| 42 | Opening in the form of an eye |
| 43 | Second arm |
| 44 | Latching surface |
| 45 | Latching tab |
| 46 | Spring arrangement |
| 47 | Spring arm |
| 48 | Spring arm |
| 49 | Tab on the catch lever |
| 50 | Joined chain |
| 51 | Step |
| 52 | Cover surface |
| 53 | Incline |
| 54 | Holding pocket |
| 55 | Centre web |
| 60 | Recess |
| 61 | Pin |
| 62, 162, 162a, 262 | Contact lever |
| 63 | Shaft |
| 64 | First lever element |
| 65 | Second lever element |
| 66 | Elongated hole |
| 67 | Accommodation area |
| 68, 168, 168a | Moving contact piece |
| 69 | Contact compression spring |
| 70, 170, 170a | Fixed contact piece |
| 71 | Stop |
| 72 | Coil |
| 73, 173, 273 | Magnetic release |
| 74 | Strip |
| 75 | Thermal release |
| 76, 176 | Fixed-position shaft |
| 77, 177, 277 | Striking lever |
| 78, 278 | First arm element |
| 79, 179 | Opening |
| 80, 280 | Transmission clip |
| 81 | Guide groove |
| 82 | Side walls |
| 83, 283 | Second arm element |
| 84, 184, 284 | Tab |
| 85 | Arc quenching arrangement |
| 86 | Wedge-shaped projection |
| 87 | Supporting surface |
| 90 | Stop |

-continued

| List of reference symbols | |
|---|---|
| 92 | Striking distance |
| 173, 273 | Striking pin |
| 120 | Bead |
| 121 | Recess for accommodation |
| 284 | Second tab |
| 285 | Aperture |
| 290 | Second stop |
| 374 | Collar |

What is claimed is:

1. An electrical service switching device comprising:

a housing including a separation point having a first end and a second end;

a rotation shaft arranged in the housing at a fixed position;

a first assembly configured to be arranged in the housing at the first end of the separation point, the first assembly including a contact lever configured to pivot on the rotation shaft;

a second assembly configured to be arranged in the housing at the second end of the separation point independently of the first assembly, the second assembly including a switching toggle, a tripping lever, a catch lever, an intermediate lever, and a clip;

a fixed contact piece;

a moving contact piece arranged on the contact lever;

a magnetic release including a magnet armature configured to act on the contact lever to separate the fixed contact piece from the moving contact piece during a magnetic tripping; and a thermal release configured to separate the fixed contact piece from the moving contact piece during a thermal tripping, wherein the tripping lever and the catch lever are configured to separate when the moving contact piece is separated from the fixed contact piece and latch together when the moving contact piece is connected to the fixed contact piece, wherein the catch lever includes an elongated hole configured to guide the clip and is mounted in a fixed position such that the catch lever is configured for rotation, wherein the switching toggle is configured to enable manual connection of the moving contact piece to the fixed contact piece and enable manual separation of the moving contact piece from the fixed contact piece, wherein the intermediate lever includes a first end articulated with the contact lever and a second end articulated on the clip, wherein the switching toggle includes at least one limb articulated with the clip, wherein the separation point comprises a coupling point between the first end of the intermediate lever and a free end of the contact lever, wherein the clip includes two U-limbs so as to be approximately U-shaped, the U-limbs each including a respective free end, wherein the clip further includes a clip web which connects the two U-limbs, and guide projections which are integrally formed at the free ends of the U-limbs, wherein the clip web is configured to be guided for movement in the elongated hole in the catch lever, wherein the switching toggle includes a switching handle and two projections diametrically opposite the switching handle, wherein the projections are integrally arranged in the form of a fork having opposed projection surfaces and an accommodation area between the opposed projection surfaces, which is open on one side of the switching toggle, and wherein one of the guide projections of the clip is held so as to be pivotable in each of the two projections.

2. The electrical service switching device according to claim 1, wherein the intermediate lever has a U-profile, which ends in two projections at the second end which are arranged in the form of a fork, and wherein each of the two projections which are arranged in the form of the fork has a corresponding latching opening.

3. The electrical service switching device according to claim 2, wherein the intermediate lever is articulated with the clip web, and the projections which are arranged in the form of the fork are configured to clasp the catch lever.

4. The electrical service switching device according to claim 3, wherein the tripping lever comprises a first arm configured to latch in an articulated manner with the switching toggle on a rotation axis of the switching toggle, and is surrounded by the two projections, which are in the form of the fork, of the switching toggle.

5. The electrical service switching device according to claim 4, comprising two projections on each of two sides, respectively, of the catch lever so as to connect the second assembly to the housing.

6. An electrical service switching device comprising:

a housing including a separation point having a first end and a second end;

a rotation shaft arranged in the housing at a fixed position;

a first assembly configured to be arranged in the housing at the first end of the separation point, the first assembly including a contact lever configured to pivot on the rotation shaft;

a second assembly configured to be arranged in the housing at the second end of the separation point independently of the first assembly, the second assembly including a switching toggle, a tripping lever, a catch lever, an intermediate lever, and a clip;

a fixed contact piece;

a moving contact piece arranged on the contact lever;

a magnetic release including a magnet armature configured to act on the contact lever to separate the fixed contact piece from the moving contact piece during a magnetic tripping;

a thermal release configured to separate the fixed contact piece from the moving contact piece during a thermal tripping; and a striking lever configured to pivot in a fixed-position shaft, wherein the magnet armature and the thermal release each are configured to act on the tripping lever via the striking lever, wherein the tripping lever and the catch lever are configured to separate when the moving contact piece is separated from the fixed contact piece and latch together when the moving contact piece is connected to the fixed contact piece, wherein the catch lever includes an elongated hole configured to guide the clip and is mounted in a fixed position such that the catch lever is configured for rotation, wherein the switching toggle is configured to enable manual connection of the moving contact piece to the fixed contact piece and enable manual separation of the moving contact piece from the fixed contact piece, wherein the intermediate lever includes a first end articulated with the contact lever and a second end articulated on the clip, and wherein the switching toggle includes at least one limb articulated with the clip.

7. The electrical service switching device according to claim 6, comprising a stop connected to the housing in a fixed position and configured to limit a movement path of the contact lever.

8. The electrical service switching device according to claim 7, wherein the separation point comprises a coupling point between the first end of the intermediate lever and a free end of the contact lever.

9. The electrical service switching device according to claim 6, wherein the separation point comprises a coupling point between the first end of the intermediate lever and a free end of the contact lever.

10. The electrical service switching device according to claim 9, wherein the clip includes two U-limbs so as to be approximately U-shaped, the U-limbs each including a respective free end, and wherein the clip further includes a clip web which connects the two U-limbs, and guide projections which are integrally formed at the free ends of the U-limbs.

11. The electrical service switching device according to claim 10, wherein the clip web is configured to be guided for movement in the elongated hole in the catch lever.

12. The electrical service switching device according to claim 6, wherein the striking lever is a double-armed lever including a first arm and a second arm.

13. The electrical service switching device according to claim 12, wherein the magnet armature and the thermal release are each configured to act on and pivot the first arm of the striking lever, wherein the second arm of the striking lever is configured to act on the tripping lever and pivots the tripping lever such that the tripping lever is apart from the catch lever.

14. The electrical service switching device according to claim 13, comprising a strain-relief clamp, wherein the tripping lever comprises an arm, wherein the thermal release is connected to the striking lever via the strain-relief clamp, and wherein, when the moving contact piece is connected to the fixed contact piece, the arm of the tripping lever runs approximately parallel to the strain-relief clamp, and the striking lever with the strain-relief clamp and the arm of the tripping lever each are positioned approximately at right angles.

15. The electrical service switching device according to claim 14, wherein the magnet armature is configured to strike the striking lever against the contact lever in order to quickly connect the moving contact piece with the fixed contact piece.

16. The electrical service switching device according to claim 14, wherein, during magnetic tripping, the magnet armature is configured to pivot the striking lever against the tripping lever, and, after the pivoting, to strike against the contact lever in order to separate the fixed contact point from the moving contact point.

17. The electrical service switching device according to claim 12, wherein the tripping lever includes an arm, wherein the magnet armature is configured to act on and pivot the first arm of the striking lever, such that the second arm of the striking lever acts on and pivots the arm of the tripping lever such that the tripping lever and the catch lever separate, and wherein the thermal release is configured to act via at least one of a pressure clip directly on the tripping lever in order to separate the tripping lever and the catch lever and a pressure clip on the second arm of the striking lever.

18. The electrical service switching device according to claim 17, comprising a fixed-position stop, wherein, in the event of sinking, the contact lever is held by the fixed-position stop in a position such that the pivoting of the tripping lever in the event of tripping is not impeded by the contact lever.

19. The electrical service switching device according to claim 6, wherein the striking lever includes a first, inner part and a second, outer part and is split along an imaginary plane parallel to broad faces of the housing broad such that the magnetic release acts on the first, inner part of the striking lever during the magnetic tripping, and the thermal release acts on a second, outer part of the striking lever during the thermal tripping.

20. The electrical service switching device according to claim 6, comprising a fixed-position stop, wherein the pivoting of the striking lever is configured to be limited by the fixed-position stop.

21. The electrical service switching device according to claim 6, comprising a fixed-position stop configured to limit sinking of the contact lever.

22. The electrical service switching device of claim 6, wherein the electrical service switching device is a circuit breaker.

23. An electrical service switching device comprising:

a housing including a separation point having a first end and a second end;

a rotation shaft arranged in the housing at a fixed position;

a first assembly configured to be arranged in the housing at the first end of the separation point, the first assembly including a contact lever configured to pivot on the rotation shaft;

a second assembly configured to be arranged in the housing at the second end of the separation point independently of the first assembly, the second assembly including a switching toggle, a tripping lever, a catch lever, an intermediate lever, and a clip;

a fixed contact piece;

a moving contact piece arranged on the contact lever;

a magnetic release including a magnet armature configured to act on the contact lever to separate the fixed contact piece from the moving contact piece during a magnetic tripping;

a thermal release configured to separate the fixed contact piece from the moving contact piece during a thermal tripping; and a fixed-position stop configured to limit sinking of the contact lever, wherein the fixed-position stop comprises a projection mounted in the housing, wherein the tripping lever and the catch lever are configured to separate when the moving contact piece is separated from the fixed contact piece and latch together when the moving contact piece is connected to the fixed contact piece, wherein the catch lever includes an elongated hole configured to guide the clip and is mounted in a fixed position such that the catch lever is configured for rotation, wherein the switching toggle is configured to enable manual connection of the moving contact piece to the fixed contact piece and enable manual separation of the moving contact piece from the fixed contact piece, wherein the intermediate lever includes a first end articulated with the contact lever and a second end articulated on the clip, and wherein the switching toggle includes at least one limb articulated with the clip.

* * * * *